US011440330B2

(12) United States Patent
Devries et al.

(10) Patent No.: US 11,440,330 B2
(45) Date of Patent: Sep. 13, 2022

(54) LIQUID DELIVERY IN AN INKJET TYPE DISPENSER

(71) Applicant: HEWLETT-PACKARD DEVELOPMENT COMPANY, L.P., Spring, TX (US)

(72) Inventors: Mark A Devries, Corvallis, OR (US); Paul Mark Haines, Corvallis, OR (US); Ronald J Ender, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/500,396

(22) PCT Filed: Jul. 8, 2018

(86) PCT No.: PCT/US2018/041173
§ 371 (c)(1),
(2) Date: Oct. 2, 2019

(87) PCT Pub. No.: WO2020/013799
PCT Pub. Date: Jan. 16, 2020

(65) Prior Publication Data
US 2021/0323314 A1 Oct. 21, 2021

(51) Int. Cl.
*B41J 2/175* (2006.01)
*B41J 2/18* (2006.01)

(52) U.S. Cl.
CPC ..... *B41J 2/18* (2013.01); *B41J 2/17503* (2013.01); *B41J 2/17566* (2013.01); *B41J 2/17596* (2013.01)

(58) Field of Classification Search
CPC ..... B41J 2/17503; B41J 2/17566; B41J 2/17596; B41J 2/18
See application file for complete search history.

(56) References Cited

U.S. PATENT DOCUMENTS

| | | | |
|---|---|---|---|
| 5,159,348 | A | 10/1992 | Dietl et al. |
| 5,704,403 | A | 1/1998 | Schwenk et al. |
| 5,801,735 | A | 9/1998 | Lorenze et al. |
| 5,880,748 | A | 3/1999 | Childers et al. |
| 6,224,198 | B1 | 5/2001 | Cook et al. |
| 8,465,133 | B2 | 6/2013 | Park et al. |

(Continued)

FOREIGN PATENT DOCUMENTS

| | | | |
|---|---|---|---|
| CN | 108136787 | B | 2/2019 |
| DE | 19710678 | B4 | 5/2006 |

(Continued)

*Primary Examiner* — Matthew Luu
*Assistant Examiner* — Kendrick X Liu
(74) *Attorney, Agent, or Firm* — HP Inc. Patent Department

(57) ABSTRACT

In one example, a liquid delivery system for an inkjet type dispenser includes: a printhead unit; a reservoir separate from the printhead unit; a flow path from the reservoir through the printhead unit and back to the reservoir; an interconnect to connect a removable liquid container to the flow path; and a single pump to pump ink along the flow path: from the reservoir through the printhead unit and back to the reservoir; and from the interconnect to the reservoir when a removable liquid container is connected to the interconnect.

8 Claims, 2 Drawing Sheets

(56) References Cited

U.S. PATENT DOCUMENTS

| | | | | |
|---|---|---|---|---|
| 8,550,612 | B2 | 10/2013 | Park et al. | |
| 9,365,045 | B2 | 6/2016 | Shibata | |
| 2002/0047882 | A1 | 4/2002 | Karlinski et al. | |
| 2002/0113836 | A1* | 8/2002 | Sonobe | B41J 2/16588 347/22 |
| 2004/0046841 | A1 | 3/2004 | Cheok | |
| 2007/0279461 | A1* | 12/2007 | Hiratsuka | B41J 2/17596 347/85 |
| 2010/0165023 | A1* | 7/2010 | Suzuki | B41J 2/18 347/10 |
| 2011/0074842 | A1 | 3/2011 | Hyakudome et al. | |
| 2014/0009538 | A1 | 1/2014 | Balala et al. | |

FOREIGN PATENT DOCUMENTS

| | | | |
|---|---|---|---|
| KR | 20150038023 | A | 4/2015 |
| WO | 98/17478 | A1 | 4/1998 |
| WO | WO2012030385 | A1 | 3/2012 |

* cited by examiner

LIQUID DELIVERY IN AN INKJET TYPE DISPENSER

BACKGROUND

Inkjet type dispensing devices dispense liquid onto a substrate in the form of drop or streams with a so-called printhead or an array of printheads. For example, inkjet printers dispense ink onto paper and other print substrates. For another example, some additive manufacturing machines dispense liquid fusing agents onto a powdered build material with an inkjet type dispenser. Additive manufacturing machines that use inkjet type dispensers are commonly referred to as 3D printers.

DRAWINGS

The same part numbers designate the same or similar parts throughout the figures.

DESCRIPTION

Figure 1:
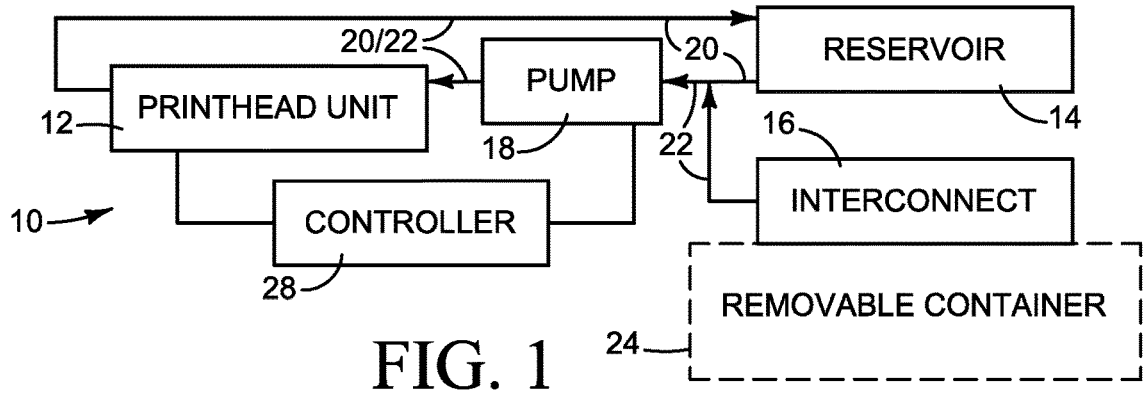
FIG. 1 is a diagram illustrating one example of a liquid delivery system for an inkjet type dispenser.

In some inkjet printers, the printheads are assembled in a printbar that spans a full width of the print substrate. Ink is pumped to the printbar from a permanent reservoir separate from the printbar to continuously supply the printheads with ink. The pump circulates ink from the reservoir to the printbar and back to the reservoir to remove air from the printbar and to maintain ink pressure to the printheads during printing. When the printheads are idle, the pump may be run to circulate ink to keep ink components mixed and to continue to carry air away from the printbar. A separate reservoir, pump, and flow path are used for each of the different color inks, and for each of any other printing liquids that may be dispensed by the printheads. This type of ink delivery system is sometimes called a "continuous ink" system.

Currently, the reservoirs in a continuous ink delivery system are refilled manually by pouring ink into each reservoir or from a removable supply container connected to the reservoir through a gravity fed "bubbler" interconnect or other venting mechanism. Manual refills are difficult to perform while printing, and can be messy and prone to spills. Bubbling refills use a comparatively large interconnect and tall supply container to achieve higher refill rates and, therefore, may not scale well to larger, higher volume printers. Also, bubbling refill containers should be located near the reservoir to facilitate air transfer, thus limiting the physical configuration of the printer.

A new ink delivery system has been developed to avoid the difficulties associated with existing reservoir refill processes in continuous ink delivery systems. A single pump may be used to circulate ink through the printbar, as described above, and to pump ink from a removable supply container to the reservoir to refill the reservoir without interrupting the flow of ink to the printbar and with minimal changes to the existing flow path. The same pump now used in some inkjet printers to pump ink to the printheads may also be used to pump ink from a removable container to refill the reservoir.

In one example, an ink delivery system includes a reservoir (separate from the printbar or other printhead unit), a flow path from the reservoir through the printhead unit and back to the reservoir, an interconnect to connect a removable ink container to the flow path, and a single pump to pump ink along the flow path (1) from the reservoir through the printhead unit and back to the reservoir and (2) from the interconnect to the reservoir when a removable liquid container is connected to the interconnect. The interconnect may be implemented, for example, as a passive flow device such as a needle/septum interface or a check valve that is open when a refill container is connected to the interconnect (or when pumping pressure is applied to the interconnect) and closed when a refill container is not connected to the interconnect (or when pumping pressure is not applied to the interconnect). Pressure in this context, where the pump pulls liquid from the reservoir or from a removable refill container, means negative gauge pressure (i.e., suction).

In one example, the refill flow path from the interconnect to the reservoir follows the normal ink circulation path through the printbar so that the reservoir may be refilled without interrupting the flow of ink to the printbar, thus enabling the printer to print during refill. In one example, the ink delivery system includes a check valve or other suitable pressure control device at the outlet from the reservoir to enable the preferential flow of ink from the refill container by making the pressure to pull liquid from the reservoir greater than the pressure to pull ink from the refill container.

Examples of the new ink delivery system, using a single pump for normal printing operations and for refilling the reservoir, avoids the cost and complications of a dual pump system and allows greater freedom to position the refill station away from the printer while still delivering satisfactory refill rates for higher volume printers.

Examples are not limited to ink, printbars or inkjet printing in general. Examples may be implemented with other printhead units, other inkjet type dispensers and for other liquids. The examples described herein illustrate but do not limit the scope of the patent, which is defined in the Claims following this Description.

As used in this document, "and/or" means one or more of the connected things and a "liquid" means a fluid not composed primarily of a gas or gases.

FIG. 1 is a diagram illustrating one example of a liquid delivery system 10 for an inkjet type dispenser. Referring to FIG. 1, system 10 includes a printhead unit 12, a permanent reservoir 14 separate from printhead unit 12, an interconnect 16, a pump 18, a supply flow path 20 from reservoir 14 through printhead unit 12 and back to reservoir 14, and a refill flow path 22 from interconnect 16 to reservoir 14. System 10 also sometimes includes a removable liquid container 24. Removable container 24 is depicted with dashed lines in the figures to indicate a removable component that is not a permanent part of liquid delivery system 10.

Printhead unit 12 includes one or multiple printheads and flow structures to carry ink or other liquid to the printhead(s). A printhead unit 12 usually will also include a pressure regulator or other flow control device to help control the flow of liquid to each printhead. Although a single printhead unit 12 is shown, system 10 may include multiple printhead units 12. Printhead unit 12 may be implemented, for example, as a substrate wide printbar in an inkjet printer to dispense ink and/or other printing liquids, or as an agent dispenser in an additive manufacturing machine to dispense fusing, detailing, coloring, and/or other liquid manufacturing agents. Each of multiple liquid delivery systems 10 may be used to delivery each of multiple corresponding liquids.

During a dispensing operation, when a container 24 is not connected to interconnect 16, pump 18 pumps a liquid 26 (shown in FIGS. 2 and 3) from reservoir 14 along supply flow path 20 through printhead unit 12 and back to reservoir 14, for example at the direction of a controller 28. Controller 28 represents the processing and memory resources, programming, and the electronic circuitry and components needed to control the operative components of system 10, and may include distinct control elements for individual system components. When the printhead(s) are idle, pump 18 may be run to continue to circulate liquid through printhead unit 12, for example to keep ink or other components of the liquid mixed and to carry air away from the printhead(s).

During a refill operation, when a removable container 24 is connected to interconnect 16, pump 18 pumps a liquid 26 from container 24 along refill flow path 22 to reservoir 14, for example at the direction of controller 28. In the example shown in FIG. 1, refill flow path 22 is coextensive with supply flow path 20 through pump 18 and printhead unit 12 such that liquid continues to circulate through printhead unit 12 during refill. Consequently, the printhead(s) are supplied with liquid while refilling reservoir 14 and dispensing operations may continue, if desired, during refill. Interconnect 16 allows liquid to flow out of a container 24 into flow path 22 and to seal against the pump pressure when a container 24 is not connected to interconnect 16. Interconnect 16 may be implemented, for example, as a needle/septum seal, a humidor or other suitable passive flow device, or as an active valve which usually will be operated automatically at the direction of a controller 28, to allow the flow of liquid from container 24 into flow path 22 when a container 24 is connected to interconnect 16.

Figure 2:
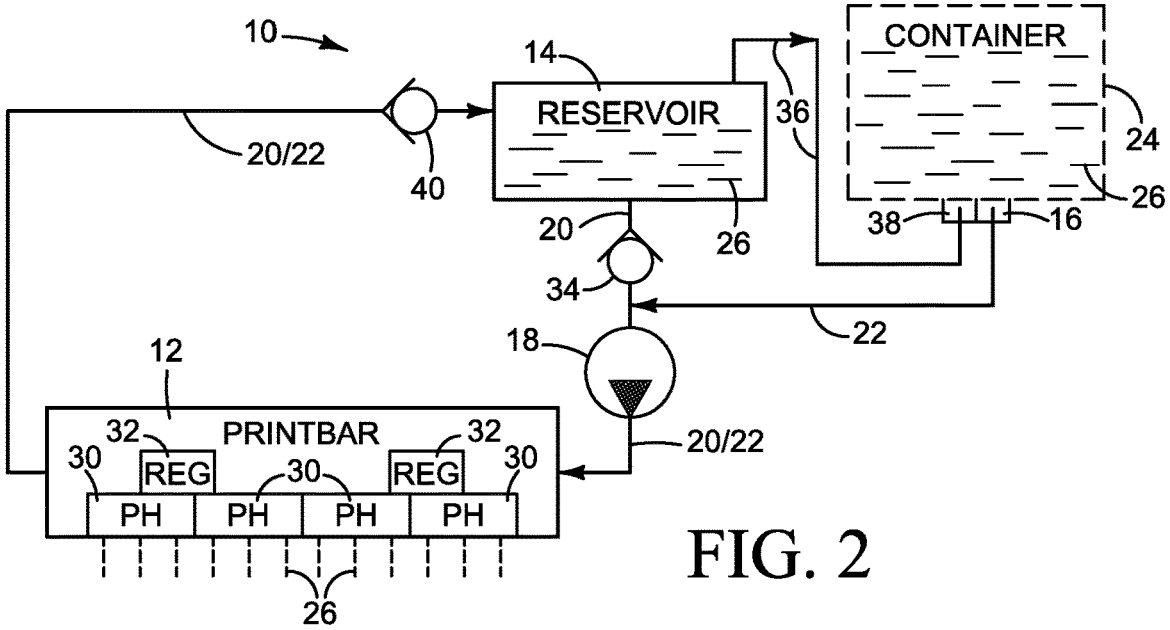
FIG. 2 is a diagram illustrating one example implementation for a liquid delivery system shown in FIG. 1.

FIG. 2 is a diagram illustrating one example implementation for a liquid delivery system 10 shown in FIG. 1. In the example shown in FIG. 2, printhead unit 12 is implemented as a printbar with multiple printheads 30 and flow regulators 32 each to regulate the flow of liquid to the corresponding printheads 30. A check valve or other suitable pressure control device 34 is positioned in supply flow path 20 between reservoir 14 and pump 18, upstream from refill flow path 22, to enable the preferential flow of liquid from a removable container 24. For example, the cracking pressure of a check valve 34 may be higher than the pressure to pull liquid 26 from container 24 through interconnect 16, so that liquid 26 comes only from container 24 when a container 24 is connected to interconnect 16.

In this example, system 10 also includes a third flow path 36 from reservoir to a second interconnect 38 for removable container 24. Air is pushed out of reservoir 14 into container 24 through interconnect 38 as the reservoir fills with liquid 26. Flow path 36 also allows liquid 26 to flow from reservoir 14 into container 24 so that liquid will circulate through system 10 when reservoir 14 is full, making the refill process self-limiting. Measuring or monitoring the level of liquid in reservoir 14 during refill is optional because the liquid will circulate when the reservoir is full until the removable refill container 24 is disconnected. Also, where the pumps 18 in multiple delivery systems 10 are driven by a single motor, the example shown in FIG. 2 allows the motor to continue to run even after one reservoir 14 is full to continue to fill the other reservoir(s) 14.

When a container 24 is not connected to interconnect 16, air is vented to the atmosphere from reservoir 14 through flow path 36 and interconnect 38. Interconnect 38 may be implemented as a needle/septum interface, for example, to vent reservoir 14 and seal a container 24 when a container 24 is not connected. Outflow interconnect 16 and inflow interconnect 38 may be incorporated into a single interconnect assembly.

Also, in this example, a check valve or other suitable pressure control device 40 is positioned in flow path 20/22 between printbar 12 and reservoir 14 to allow pump 18 to maintain positive gauge pressure at regulators 32 when not refilling reservoir 14 from a container 24.

Figure 3:
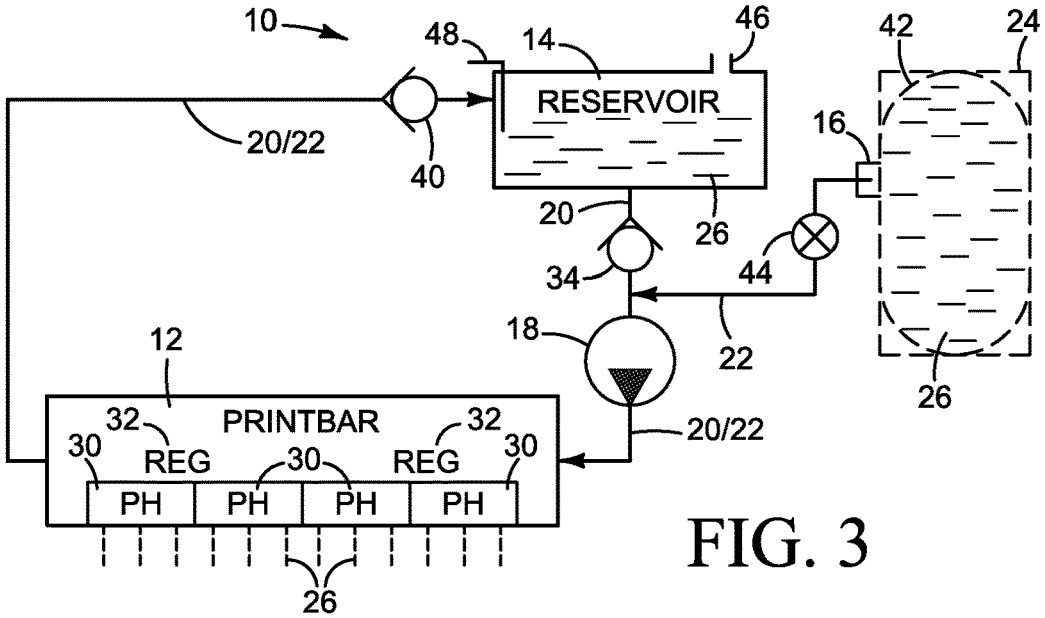
FIG. 3 is a diagram illustrating another example implementation for a liquid delivery system shown in FIG. 1.

FIG. 3 is a diagram illustrating another example implementation for a liquid delivery system 10 shown in FIG. 1. In the example shown in FIG. 3, liquid 26 is contained in an air-free collapsible bag 42 in removable container 24. An active valve 44 is positioned in flow path 22 between interconnect 16 and pump 18 to help control the flow of liquid from interconnect 16 to reservoir 14. Valve 44 is operative between a first position to block the flow of liquid 26 from interconnect 16 along flow path 22 and a second position to not block the flow of liquid 26 from interconnect 16 along flow path 22, for example at the direction of controller 28 (controller 28 is shown in FIG. 1). Also, in this example, reservoir 14 is vented to the atmosphere through a vent 46. Where reservoir 14 is vented to the atmosphere as shown in FIG. 3, a sensor 48 may be used to detect the level of liquid 26 in reservoir 14 to signal the controller to close valve 44 when reservoir 14 is full.

FIGS. 1-3 show example configurations for liquid delivery system 10. Other suitable configurations may be possible.

Figure 4:
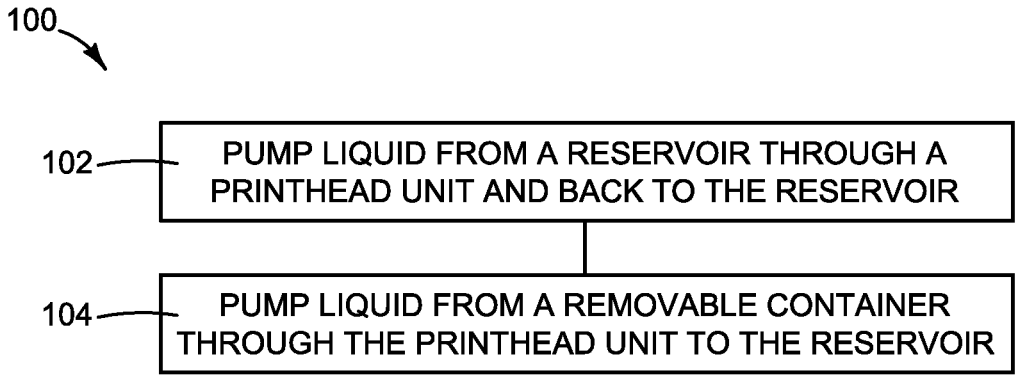
FIG. 4 is a flow diagram illustrating one example of a liquid delivery process for an inkjet type dispenser.

FIG. 4 is a flow diagram illustrating one example liquid delivery process for an inkjet type dispenser, such as might be implemented with a system 10 shown in FIGS. 1-3. Referring to FIG. 4, a process 100 includes pumping liquid from a reservoir through a printhead unit and back to the reservoir (block 102) and pumping liquid from a removable container through the printhead unit to the reservoir when the removable container is connected to the system (block 104). In one example, liquid is pumped from the reservoir back to the container, for example as described above with reference to FIG. 2. In one example, liquid is vented from the reservoir to the removable container, for example as described above with reference to FIG. 2. In one example, a single pump is used to pump liquid from the reservoir through the printhead unit and back to the reservoir in block 102 and to pump liquid from the removable container through the printhead unit to the reservoir in block 104, for example as described above with reference to FIGS. 1-3.

As noted at the beginning of this Description, the examples shown in the figures and described above illustrate but do not limit the scope of the patent, which is defined in the following Claims.

"A" and "an" as used in the Claims means one or more.

The invention claimed is:

1. A liquid delivery system for an inkjet type dispenser, comprising:

a printhead unit;

a reservoir separate from the printhead unit;

a flow path from the reservoir through the printhead unit and back to the reservoir;

an interconnect to connect a removable liquid container to the flow path; and a single pump to pump ink along the flow path:

from the reservoir through the printhead unit and back to the reservoir; and from the interconnect to the reservoir when the removable liquid container is connected to the interconnect, where the pump is to pull liquid from the reservoir and from the removable liquid container when the container is connected to the interconnect; and a pressure control device to inhibit the flow of liquid from the reservoir so that a pressure to pull liquid from the reservoir is greater than a pressure to pull liquid from the container connected to the interconnect.

2. The system of claim 1, where the pump is to pull liquid from the container when the container is connected to the interconnect.

3. The system of claim 1, comprising a valve operative between a first position to block a flow of liquid from the container connected to the interconnect into the flow path and a second position to not block a flow of liquid from the container connected to the interconnect.

4. The system of claim 1, where the flow path from the interconnect to the reservoir goes through the printhead unit.

5. The system of claim 1, comprising the container connected to the interconnect.

6. The system of claim 1, where the printhead unit comprises a printbar having multiple printheads.

7. A liquid delivery system for an inkjet type dispenser, comprising:

a printhead unit;

a reservoir separate from the printhead unit;

a flow path from the reservoir through the printhead unit and back to the reservoir;

an interconnect to connect a removable liquid container to the flow path; and a pump to pump ink along the flow path:

from the reservoir through the printhead unit and back to the reservoir; and from the interconnect through the printhead unit to the reservoir when the container is connected to the interconnect, where the pump is to pull liquid from the reservoir and from the container when the container is connected to the interconnect; and a pressure control device to inhibit the flow of liquid from the reservoir so that a pressure to pull liquid from the reservoir is greater than a pressure to pull liquid from the container connected to the interconnect.

8. The system of claim 7, where the pump is a single pump.

* * * * *